US005261554A

United States Patent [19]

Forbes

[11] Patent Number: 5,261,554

[45] Date of Patent: Nov. 16, 1993

[54] INSULATED BEVERAGE CONTAINER

[76] Inventor: David G. Forbes, Rt. 11, Box 313, Tyler, Tex. 75709

[21] Appl. No.: 701,860

[22] Filed: May 17, 1991

[51] Int. Cl.[5] ..... A45C 11/00

[52] U.S. Cl. ..... 220/412; 220/356; 220/625; 220/739; 220/740; 224/257

[58] Field of Search ..... 220/4.05, 4.07, 8, 410, 220/412, 413, 468, 355, 356, 625, 635, 94 R, 739, 740; 224/257, 258

[56] References Cited

U.S. PATENT DOCUMENTS

| | | | |
|---|---|---|---|
| 1,850,013 | 3/1932 | Hinkley | 220/412 |
| 3,843,032 | 10/1974 | Moran et al. | 224/258 |
| 4,018,371 | 4/1977 | George | 224/5 W |
| 4,119,248 | 10/1978 | Butler et al. | 220/412 |
| 4,228,908 | 10/1980 | Tweeton | 220/412 |
| 4,293,015 | 10/1981 | McGough | 220/412 |
| 4,541,540 | 9/1985 | Gretz et al. | 220/412 |
| 4,823,974 | 4/1989 | Crosser | 220/412 |
| 4,861,301 | 8/1989 | Pomeroy et al. | 220/412 |

*Primary Examiner*—Joseph Man-Fu Moy
*Attorney, Agent, or Firm*—John M. Harrison

[57] ABSTRACT

An insulated beverage container which includes a cylindrical shell, insulation provided inside the shell and a tube bore defined by the insulation for insertion of canned or bottled drinks and keeping the drinks hot or cold. A pair of circular collars terminate each end of the shell and insulation tube and define an upward-projecting collar lip for receiving a corresponding circular lip slot provided in a pair of lids adapted to seal the ends of the insulated beverage container. A flexible strap extends through aligned collar strap guides and lid strap guides to connect the lids to the collars of the insulated beverage container and a clip receptacle is provided on one of the collars for receiving the clip and securing one of the lids to the collar. A buckle and snap may also be provided on the strap for securing the insulated beverage container to another object.

20 Claims, 1 Drawing Sheet

INSULATED BEVERAGE CONTAINER

BACKGROUND OF THE INVENTION

1. Field of the Invention

This invention relates to insulated containers for maintaining products in a cold or hot condition and more particularly, to an insulated beverage container which is characterized by a cylindrical shell encapsulating an insulation tube having a tube bore for insertion of hot or cold, bottled or canned drinks. A pair of circular collars terminate each end of the insulation tube and are fitted with an upward-standing, circular collar lip which inserts in corresponding circular lip slots provided in a pair of lids which are attached to the collars, respectively, by means of an adjustable flexible strap. In a preferred embodiment the strap is inserted through aligned lid strap guides and collar strap guides provided in the lids and collars, respectively, and a clip is provided at one end of the strap for insertion in a corresponding clip receptacle located on the collars to secure at least one lid tightly on a corresponding collar. The insulated beverage container may be constructed in any desired length and diameter and is especially well suited to contain chilled beverage cans or bottles in the rigid tube. The insulation is typically closed-cell polyethylene and the exterior shell and collars may be constructed of high impact polystyrene, in non-exclusive particular. The circular collars are typically glued to the ends of the tube and the lids are constructed with a sufficiently close tolerance so that pressing the lids tightly on the collars creates a water-proof and air-proof seal.

Glass and canned food and beverage containers are normally maintained in a chilled or hot condition by immersion in ice, ice water, a refrigerated medium or in an insulated container of some description to maintain the heat or cold content at a desired level as long as possible. It-is particularly desirable to provide a small, compact highly efficient, substantially water and air-proof container which will maintain the contents of jars, bottles, cans and other containers in a hot or cold condition for a long period of time, for such applications as golfing, tennis, hiking, backpacking, camping, biking and like activities.

2. Description of the Prior Art

Various coolers, containers and carrying devices provided with insulation designed to maintain jars, cans, bottles and other containers in a hot or cold condition, are well known in the art. Typical of these containers are small ice chests, thermos bottles and like devices which are insulated to maintain ice over a period of time and to contain both hot and cold liquids with a desired level of heat or cold over an extended period of time. One of the problems associated with these devices in the bulky nature and lack of compactness in the designs, thereby necessitating a considerable amount of space to store and locate the container. Furthermore, these devices are typically not extremely efficient in maintaining tile contents in an air and water-sealed condition.

Accordingly, it is an object of this invention to provide a new and improved insulated container for containing food and beverage containers, which insulated container is compact, substantially air and water-tight and easily opened and closed at one or both ends to access one or more containers in the interior thereof.

Another object of this invention is to provide a new and improved tubular insulated beverage container for containing food and beverage products sealed in jars, bottles or cans and maintaining the food and beverage products in a hot or cold condition for an extended period of time.

Still another object of this invention is to provide a new and improved tubular insulated beverage container leaving removable lids at both ends for containing glass and metal food containers and maintaining the food in these containers in a hot or cold condition for an extended period of time.

A still further object of this invention is to provide a cylindrical insulated beverage container which is characterized by a high impact shell and an insulated tube fitted with circular end collars and removable lids for removably sealing food and beverage containers inside the insulated tube and maintaining the food and beverage in the food and beverage containers in a hot or cold condition for an extended period of time.

SUMMARY OF THE INVENTION

These and other objects of the invention are provided in an insulated beverage container which is characterized by an insulated tube of selected length provided with circular end collars having removable, sealing lids and a flexible connecting strap for maintaining at least one of the lids in a closed condition on one end of the insulated tube. In a preferred embodiment, the size of the tube bore is chosen in close tolerance to the food or beverage container to be contained therein to facilitate extending the hot or cold condition of the food in the encapsulated food or beverage container for a long period of time.

BRIEF DESCRIPTION OF THE DRAWING

The invention will be better understood by reference to the accompanying drawing, wherein.

DESCRIPTION OF THE PREFERRED EMBODIMENTS

Figure 1:
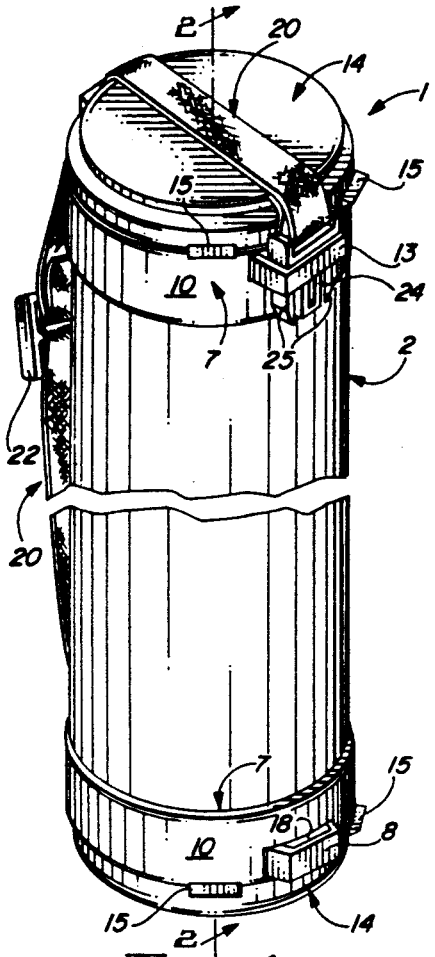
FIG. 1 is a perspective view of a preferred embodiment of the insulated beverage container of this invention.
Figure 2:
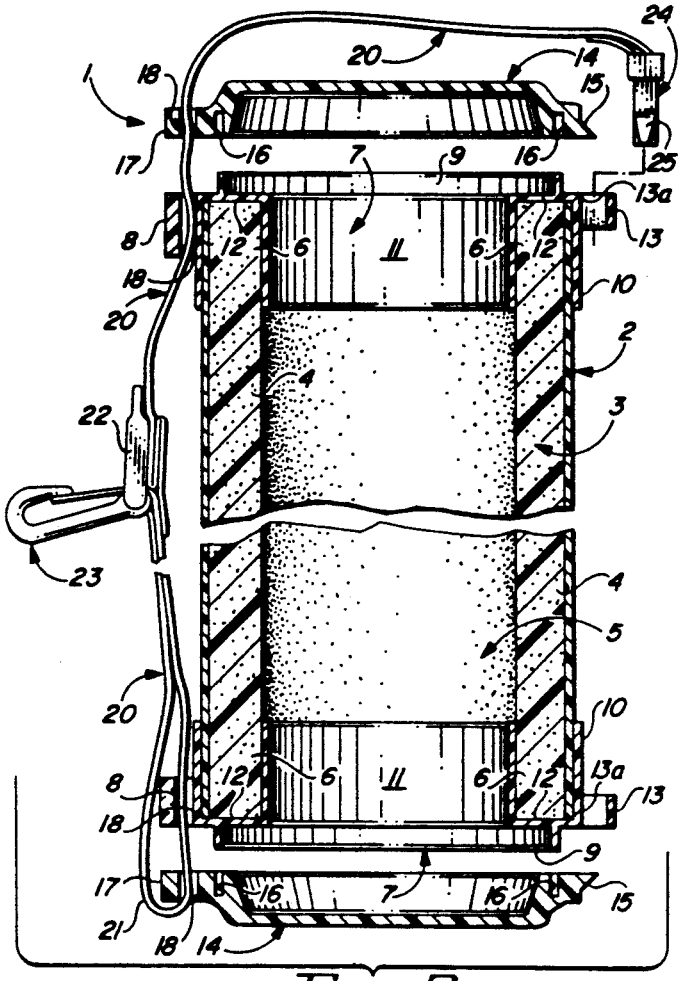
FIG. 2 is a sectional view taken along line 2—2 of the insulated beverage container illustrated in FIG. 1.

Referring initially to FIGS. 1 and 2 of the drawing the insulated beverage container of this invention is generally illustrated by reference numeral 1. The insulated beverage container 1 is characterized by a cylindrical shell 2, which covers an insulation tube 3 provided with insulation 4 of selected thickness. In a preferred embodiment of the invention the insulation 4 is characterized by closed cell, tubular polyethylene insulation of high efficiency. However, it will be appreciated by those skilled in the art that any expanded foam insulation, including polyurethane, polystyrene (Styrofoam) and other insulation well known to those skilled in the art may also be utilized in the insulated beverage container of this invention. In a preferred embodiment of the invention the insulation is manufactured in a seamless, tubular form to define the insulation tube 3 and when characterized by the closed cell polyethylene composition, it is at least 99 percent waterproof, allowing the insulated beverage container to float, whether full or empty, open or closed. The expanded polyethylene insulation also facilitates easy cleaning of the interior or tube bore 5 of the insulation tube 3, using mild soap and water, for example.

In a most preferred embodiment of the invention the shell 2 of the insulated beverage container 1 is manufactured of rigid, high impact polystyrene material. The high impact, sturdy nature of the polystyrene tube protects the contents of the cooler and also provides a printable surface for custom printing purposes. The circular tube ends 6 of the insulation tube 3 are fitted with a pair of circular collars 7 which are injection-molded of a plastic material such as polyethylene or polystyrene, in non-exclusive particular. In a most preferred embodiment of the invention the collars 7 are injection-molded from polystyrene, in order to form a tight bond with the polystyrene shell 2 when the collars 7 are assembled on the ends 6 of the insulation tube 3, as illustrated in FIG. 2. The collars 7 are typically glued in position to terminate the insulation tube 3, as illustrated in FIG. 2, using a glue which is suitable for polystyrene or an alternatively selected material for securing the collars 7 to the shell 2. Gluing of the collars 7 on the ends 6 of the insulation tube 3 tightly to the shell 2 further maintains a moisture and air-proof seal between tile collars 7 and the shell 2.

Figure 3:
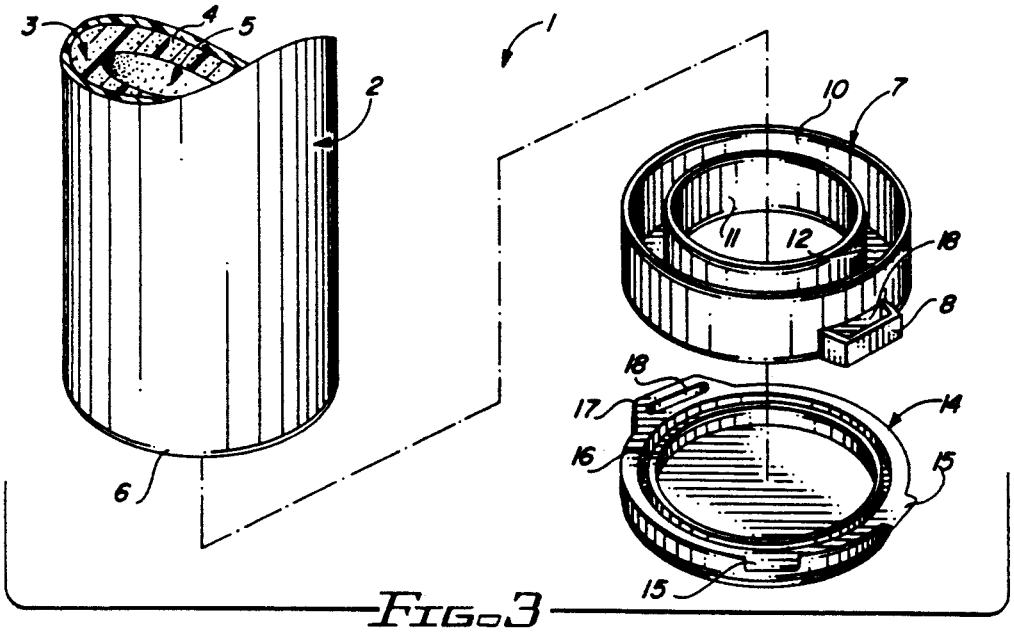
FIG. 3 is an exploded view, partially in section, of typical insulated tube, collar and lid elements of the insulated beverage container illustrated in FIGS. 1 and 2.

As further illustrated in FIGS. 2 and 3, the collars 7 are each characterized by a collar strap guide 8, fitted with a guide slot 18 for receiving a narrow, flexible strap 20 in slidable relationship. A circular collar lip 9 is molded into each of the collars 7 and is spaced from a corresponding circular outside flange 10 by a flange connector 12. Accordingly, it will be appreciated from a consideration of FIGS. 2 and 3 that the tube ends 6 of the insulation tube 3 are designed to fit concentrically in the spaces between the extending outside flange 10 and inside flange 11 and against the flange connector 12 of the collars 7, respectively. In the assembly procedure, glue is first applied in the annular space between the outside flange 10 and the inside flange 11 and the collars 7 are then inserted on the tube ends 6 of the insulation tube 3, with the outside flange 10 extending over a portion of the shell 2, to tightly secure the collar 7 on the insulation tube 3 in waterproof and air-tight orientation. A clip receptacle 13 is also molded into each of the collars 7 at the outside flange 10 and includes a receptacle slot **13*a* for receiving the flexible, spaced clip fingers 25 of a clip 24, which is attached to one end of the strap 20**.

A pair of lids 14 are designed to seal the ends of the insulation tube 3 by removable attachment to the collars 7, respectively. Each of the lids 14 is characterized by a pair of spaced lid tabs 15 for manipulating the lids 14 to and from the collars 7, respectively, and a circular lip slot 16 is provided in the lids 14 for receiving the corresponding circular collar lips 9, molded into the respective collars 7. Accordingly, when the lids 14 are aligned with the collars 7, respectively, and the collar lip 9 of each of the collars 7 is forced into the slightly smaller lip slot 16 of the corresponding lid 14, the lids 14 are tightly engaged with the collars 7, respectively, in substantially water and air-tight relationship. The lids 14 are also provided with lid strap guides 17, having guide slots 18 for receiving the flexible strap 20 and securing each of the lids 14 in close proximity to the insulation tube 3 of the insulated beverage container 1. It will be appreciated from a consideration of FIG. 2 of the drawing that the top oriented lid 14 may be secured in position on the corresponding top collar 7 by inserting the clip 24 in the corresponding receptacle slot **13*a* of a clip receptacle 13, located on the collar 7 and maintained in position by that segment of the strap 20 which engages the top lid 14. In a most preferred embodiment of the invention the strap 20 is configured to define a strap loop 21 and is fitted with a buckle 22 for tightening the strap 20 and tightly securing the lids 14 on the respective collars 7 when the clip 24 is inserted in the corresponding receptacle slot 13*a* of the clip receptacle 13. A snap 23 may also be attached to buckle 22 for connecting the insulated beverage container 1 to another object such as a golf bag, fence, baby bag or the like, or to the belt backpack or similar object, for carrying purposes. Alternatively, the strap loop 21 facilitates loosening of the buckle 22 and removing one or both of the lids 14** to insert or remove a food or beverage container, as desired.

It will be appreciated by those skilled in the-art that the insulated beverage container 1 of this invention is highly efficient to maintain food and beverage containers, whether glass or metal, in a hot or cold condition for an extended period of time, since the lids 14 may be tightly sealed on the respective collars 7 to maintain the tube bore and the contained food or beverage containers substantially in an air and water-tight environment. Furthermore, it will be recognized that either of the lids 14 may be opened to remove selected food or beverage containers, such as beverage cans of different flavor, as desired.

It will be further appreciated that the flexible strap 20 serves several purposes in the insulated beverage container 1. For example, as described above, a segment of the strap 20 extends over one of the lids 14 and maintains that lid 14 in closed configuration when the clip 24 is inserted in the receptacle slot **13*a* of the clip receptacle 13, to prevent that lid 14 from inadvertently opening. Accordingly, the insulated beverage container 1 can be positioned with the secured lid 14 at the bottom, for security purposes. The opposite lid 14 is not necessarily so retained and may be easily opened to provide ready access to the food or beverage containers located in the tube bore 5**.

It will be further appreciated by those skilled in the art that the insulated beverage container 1 may be constructed in any desired length and diameter to accommodate various types of food and beverage containers, including baby food jars, glass or plastic beverage bottles and metal beverage containers. For example, the tube bore 5 of the insulation tube 3 may be chosen to receive and contain conventional aluminum beverage cans in end-to-end relationship and maintain the contents of the cans either hot or cold for an extended period of time. Accordingly, in another most preferred embodiment of the invention the length of the insulated beverage container 1 is chosen to accommodate one or more beverage cans or containers in a close tolerance, to minimize the air space in the tube bore 5, thereby increasing the efficiency of the insulated beverage container 1.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. An insulated beverage container comprising a shell; insulation provided inside said shell and a bore provided in said insulation for accommodating at least one beverage container; collar means provided on the ends of said shell and said insulation; and lid means adapted to removably seat on said collar means and seal the beverage container in said bore.

2. The insulated beverage container of claim 1 further comprising strap means connecting said collar means and said lid means for preventing said lid means from separating more than a preselected distance from said collar means.

3. The insulated beverage container of claim 2 further comprising buckle means provided in said strap means for adjusting the length of said strap means.

4. The insulated beverage container of claim 2 further comprising clip means provided on said strap means and a clip receptacle provided on at least one of said collars for receiving said clip means and securing said strap means tightly over at least one of said lid means.

5. The insulated beverage container of claim 4 further comprising buckle means provided in said strap means for adjusting the length of said strap means.

6. The insulated beverage container of claim 2 further comprising snap means provided on said strap means for connecting said strap means and said insulated beverage container to a selected object.

7. The insulated beverage container of claim 2 further comprising buckle means provided in said strap means for adjusting the length of said strap means and snap means attached to said buckle means for connecting said strap means and said insulated beverage container to a selected object.

8. The insulated beverage container of claim 7 further comprising clip means provided on said strap means and a clip receptacle provided on at least one of said collars for receiving said clip means and securing said strap means tightly over at least one of said lid means.

9. The insulated beverage container of claim 1 wherein said shell and said insulation are tubular and each of said collar means further comprises a collar having a circular outside flange, a circular inside flange spaced from said outside flange, a circular flange connector connecting said outside flange and said inside flange and a circular collar lip projecting from said flange connector for receiving said lid means, whereby the circular ends of said insulation and said shell are inserted between said outside flange and said inside flange, respectively, for mounting said collars on said circular ends, respectively.

10. The insulated beverage container of claim 1 wherein said shell, said insulation and said collar means are circular and said lid means further comprises a circular lid and a circular lip slot provided in said circular lid for receiving said collar means.

11. The insulated beverage container of claim 10 wherein each of said collar means further comprises a collar having a circular outside flange, a circular inside flange spaced from said outside flange, a circular flange connector connecting said outside flange and said inside flange and a circular collar lip projecting from said flange connector for seating in said circular lip slot in said lid means, whereby the circular ends of said insulation and said shell are inserted between said outside flange and said inside flange, respectively, for mounting said collars on said circular ends, respectively.

12. The insulated beverage container of claim 11 further comprising at least one collar strap guide provided on said collar and at least one lid strap guide provided on said lid and flexible strap means slidably disposed in said collar strap guide and said lid strap guide for connecting said lid to said collar.

13. The insulated beverage container of claim 12 further comprising buckle means provided in said strap means for adjusting the length of said strap means.

14. The insulated beverage container of claim 12 further comprising snap means provided on said strap means for connecting said strap means and said insulated beverage container to a selected object.

15. The insulated beverage container of claim 12 further comprising:

(a) buckle means provided in said strap means for adjusting the length of said strap means; and (b) snap means provided on said buckle means for connecting said strap means and said insulated beverage container to a selected object.

16. The insulated beverage container of claim 15 further comprising clip means provided on said strap means and a clip receptacle provided on at least one of said collars for receiving said clip means and securing said strap means tightly over at least one of said lid means.

17. An insulated beverage container comprising an insulated tubular shell having a longitudinal bore for accommodating at least one beverage container; a circular collar provided on each end of said shell, said collar having a circular outside flange, a circular inside flange spaced from said outside flange, a flange connector connecting said outside flange and said inside flange and a circular collar lip projecting from said flange connector; and a circular lid removably provided on each end of said tubular shell, said lid further comprising a circular lip slot for receiving said circular outside flange of said collar, whereby the circular ends of said insulated tubular shell are inserted between said outside flange and said inside flange, respectively, for mounting said collars on said circular ends, respectively.

18. The insulated beverage container of claim 17 further comprising at least one collar strap guide provided on said collar at least one lid strap guide provided on said lid and flexible strap means slidably disposed in said collar strap guide and said lid strap guide for connecting said lid to said collar.

19. The insulated beverage container of claim 18 further comprising buckle means provided in said strap means for adjusting the length of said strap means and snap means provided on said strap means for connecting said strap means and said insulated beverage container to a selected object.

20. The insulated beverage container of claim 19 further comprising clip means provided on said strap means and a clip receptacle provided on at least one of said collars for receiving said clip means and securing said strap means tightly over at least one of said lid means.

* * * * *